US008723066B2

(12) United States Patent
Shin et al.

(10) Patent No.: US 8,723,066 B2
(45) Date of Patent: May 13, 2014

(54) DOME SWITCH DEVICE

(75) Inventors: Kyong-Su Shin, Gyeonggi-do (KR); Joon-Ho Park, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 166 days.

(21) Appl. No.: 13/360,945

(22) Filed: Jan. 30, 2012

(65) Prior Publication Data

US 2012/0193208 A1 Aug. 2, 2012

(30) Foreign Application Priority Data

Jan. 31, 2011 (KR) ..... 10-2011-0009825

(51) Int. Cl.
*H01H 1/10* (2006.01)

(52) U.S. Cl.
USPC ..... 200/512; 200/513; 200/518

(58) Field of Classification Search
USPC ..... 200/512, 513, 518, 521
See application file for complete search history.

(56) References Cited

U.S. PATENT DOCUMENTS

| | | | | | |
|---|---|---|---|---|---|
| 4,228,329 | A * | 10/1980 | Inose et al. | ..... | 200/5 A |
| 4,484,042 | A * | 11/1984 | Matsui | ..... | 200/406 |
| 4,527,021 | A * | 7/1985 | Morikawa et al. | ..... | 200/5 A |
| 6,133,536 | A * | 10/2000 | Hunag et al. | ..... | 200/5 A |
| 6,727,445 | B2 * | 4/2004 | Cullinan et al. | ..... | 200/85 R |
| 6,787,722 | B2 * | 9/2004 | Tsutsui | ..... | 200/512 |
| 8,274,358 | B2 * | 9/2012 | Ando et al. | ..... | 338/47 |

* cited by examiner

*Primary Examiner* — Kyung Lee
(74) *Attorney, Agent, or Firm* — Cha & Reiter, LLC

(57) ABSTRACT

A dome switch device enables electric contact by pressing of a central region or even any other region of a dome sheet formed to extend in a longitudinal direction with the same result regarding the amount of electrical contact. The dome switch device preferably includes a dome sheet extending along a longitudinal direction and having conductivity and a contact module provided on a substrate such that a plurality of both-pole (two-pole) contact portions are arranged alternately along the longitudinal direction of the dome sheet, in which the contact module, when being pressed regardless of where along the dome sheet is pressed, whether being pressed on a central region thereof or any other region other than the central region, electrically contacts the dome sheet with a high quality electrical contact.

20 Claims, 7 Drawing Sheets

DOME SWITCH DEVICE

CLAIM OF PRIORITY

This application claims the benefit under 35 U.S.C. §119 (a) from a Korean Patent Application filed in the Korean Intellectual Property Office on Jan. 31, 2011 and assigned Serial No. 10-2011-0009825, the entire disclosure of which is hereby incorporated by reference in its entirety.

BACKGROUND OF THE INVENTION

1. Field of the Invention

The present invention relates to a dome switch device. More particularly, the present invention relates to a dome switch device which enables electric contact by pressing.

2. Description of the Related Art

Generally, the term "portable communication devices" refers to devices by which wireless communication can be performed, while the devices are being carried. The above-mentioned portable terminals always include an antenna apparatus, a data input/output device, and a data transceiver. For the data input device, a keypad with a plurality of key buttons, which allows data input through a finger press task, is generally used. For the data output device, a display device is generally used.

The keypad typically includes dome switches for switching on/off an electric signal by being pressed by the key buttons.

As shown in FIGS. 1 through 3, a conventional dome switch 1 includes external contact portions 2*a* (FIG. 3) having the positive polarity "+" provided on a substrate 2 and internal contact portions 3 having the negative polarity "−", which recognize an electric signal by contacting the external contact portions 2*a*. The internal contact portions 3 are formed of dome sheets designed to be elastically deformed, typically by finger pressure.

In this state, as shown in FIGS. 2 and 3, upon the user's pressing of the dome sheet 3, a central portion of the dome sheet 3 moves downward and thus physically and electrically contacts the external contact portion 2*a* provided on the substrate 2, thereby generating a key input signal.

Recently, with the increasing popularity of "smart" phones, a portable communication device having a keypad with a QWERTY arrangement is often used and thus the number of dome switches 1 also increases as shown in FIG. 1.

As shown in FIG. 2, a plurality of dome switches 1 are independently arranged under a key button 4 longitudinally extending in the keypad having the QWERTY arrangement.

The extending key button 4 may comprise a space bar or an enter key and has at least one boss that extends over the dome 3 to transfer the finger pressure from above on the button 4.

As shown in FIGS. 2 and 3, however, when a region other than a central region of the dome switches 1 arranged under the boss(es) extending from key button 4 is pressed, the dome sheet 3 and the external contact portion 2*a* of the substrate 2 do not electrically contact, thus failing to recognize a key input signal or degrading a clicking sense. Moreover, since the central region of the dome switches 1 has to be consecutively pressed for correct key input, a central region of the key button 4 corresponding to the central region of the dome switches 1 can become worn out or the tension of the dome sheet 3 can become degraded over a relatively short period of time.

As shown in FIG. 2, the plurality of dome switches 1 have to be arranged under the boss(Es) extending from key button 4, increasing a manufacturing cost and assembly processes of a product.

Therefore, in the former case, there is a need in the art to improve the accuracy of key input and the clicking sense of the dome switches or to prevent abrasion of the key button and degradation of the tension of the dome sheet, a device for recognizing a signal based on electric contact upon pressing of a central region or any other region of the dome sheet.

In the latter case, there is a need in the art to eliminate the requirement of installing several dome switches under the bosses extending from the key button, and for a device in which a dome switch also extends along the substantial areas of the key button.

SUMMARY OF THE INVENTION

Accordingly, an exemplary aspect of the present invention is to provide a dome switch device in which a contact module or a contact portion is provided to include a plurality of both-pole contact portions which provide electrical contact by pressing of a central region, as well as any other region of a dome sheet extending in a longitudinal direction. In addition, another exemplary aspect of the present invention is to improve the electrical contact of components of the product, together with improvement in recognition of an electric signal of the product, and improving a clicking sense of the product.

Another exemplary aspect of the present invention is to provide a dome switch device in which a contact module or a contact portion is provided to include a plurality of both-pole contact portions which make electric contacts by pressing of a central region as well as any other region of a dome sheet extending in a longitudinal direction. Accordingly, the present invention provides an ability to equally recognize an electric signal by pressing of a region other than a central region of a key button in a keypad and thus preventing abrasion of the key button.

Moreover, another exemplary aspect of the present invention is to provide a dome switch device in which at least one tension grooves are formed in a dome sheet, thus improving a tension of a product.

Furthermore, another exemplary aspect of the present invention is to provide a dome switch device in which a dome sheet and a contact module which extend in a longitudinal direction are provided to avoid a need for installing several dome switches (e.g., dome sheets and external contact portions) arranged under an extending key button, thereby reducing a manufacturing cost of a product and improving assembly processes of the product.

In addition, another exemplary aspect of the present invention is to provide a dome switch device in which a dome sheet and a contact portion which extend in a longitudinal direction are provided to avoid a need for installing several dome switches (e.g., dome sheets and external contact portions) arranged under an extending key button, thereby reducing a manufacturing cost of a product and improving assembly processes of the product.

According to yet another exemplary aspect of the present invention, there is provided a dome switch device preferably including a dome sheet extending along a longitudinal direction and having conductivity and a contact module provided on a substrate such that a plurality of both-pole contact portions are arranged alternately along the longitudinal direction of the dome sheet, in which the contact module, when being pressed (regardless of whether being pressed on a central region thereof or any other region other than the central region), electrically contacts the dome sheet.

According to still another exemplary aspect of the present invention, there is provided a dome switch device including a dome sheet extending along a longitudinal direction and having conductivity and a contact portion provided on a substrate to be formed along the longitudinal direction of the dome sheet, in which the contact portion, when being pressed regardless of whether being pressed on a central region thereof or any other region other than the central region, electrically contacts the dome sheet.

BRIEF DESCRIPTION OF THE DRAWINGS

The above and other exemplary features and advantages of exemplary embodiments of the present invention will become more apparent from the following detailed description taken in conjunction with the accompanying drawings, in which.

DETAILED DESCRIPTION

Figure 1:
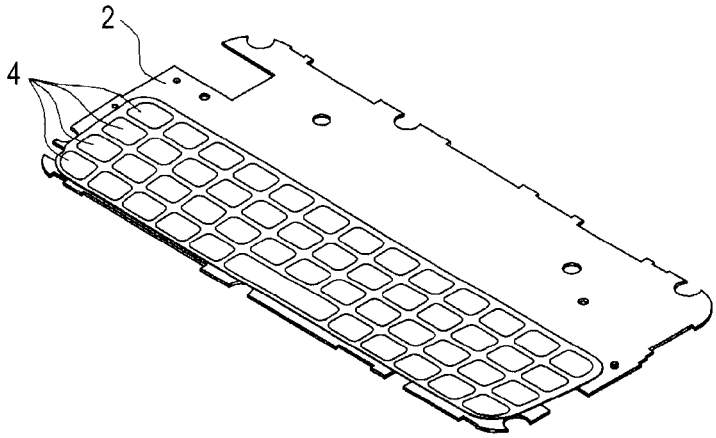
FIG.1 (PRIOR ART)
FIG. 1 is a perspective view of a conventional dome switch.

Hereinafter, an exemplary embodiment of the present invention will be described in detail with reference to the accompanying drawings. The exemplary embodiment disclosed in the specification and structures shown in the drawings are merely illustrative and provided for the artisan to understand the present invention, and the artisan will appreciate that various substitutions for components and arrangements of the exemplary embodiment may exist at the time of filing the application, and be within the spirit of the invention and the scope of the appended claims.

As shown in FIGS. 4 through 8, a dome switch device 10 according to an exemplary embodiment of the present invention preferably includes a dome sheet 20 having a conductive surface or conductive portion less than an entirety of the dome and a contact module 30 arranged under the dome sheet 20. The dome sheet 20 extends in a longitudinal direction to electrically contact the contact module 30. The contact module 30 is provided on a substrate 50 such that a plurality of both-pole contact portions 31 and 32 are arranged alternately, such as side-by-side, for example, along the longitudinal direction of the dome sheet 20. The contact module 30 electrically contacts the dome sheet 20 when a central region A1 (shown in FIG. 6) or any other region A2 of the dome sheet 20 is pressed.

Figure 4:
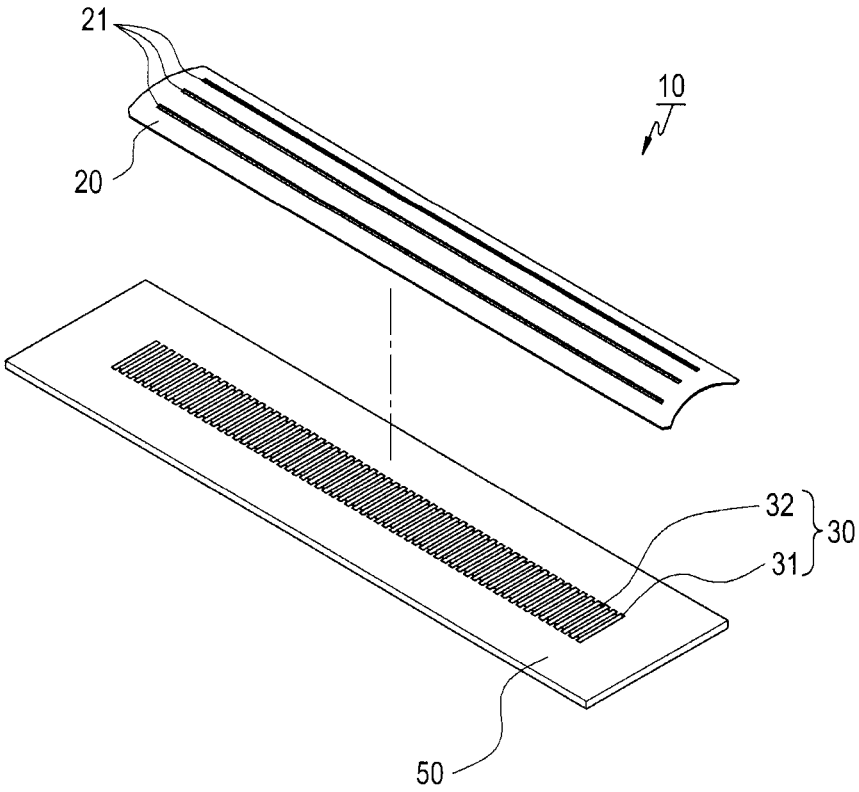
FIG. 4 is an exploded perspective view of a dome switch device according to a first exemplary embodiment of the present invention.
Figure 6:
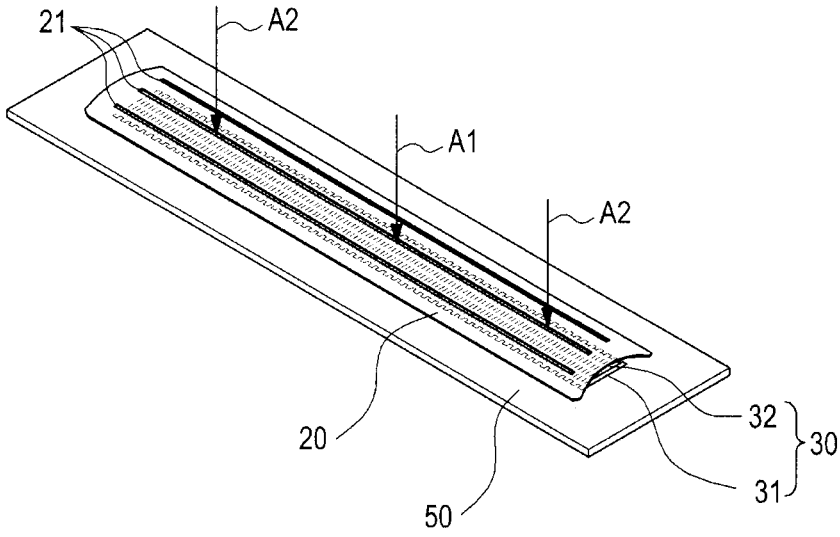
FIG. 6 is a perspective view showing a use state of a dome switch device according to a first exemplary embodiment of the present invention.
Figure 7:
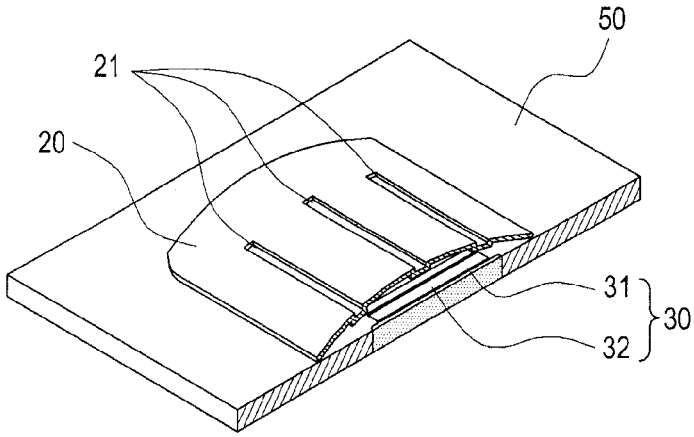
FIG. 7 is a cut-away perspective view showing a coupled state of a dome switch device according to a first exemplary embodiment of the present invention.

As shown in FIGS. 4, 6, and 7, in the dome sheet 20 are formed at least one row of tension grooves 21 along the longitudinal direction of the dome sheet 20 to improve a tension of the dome sheet 20.

Preferably, the dome sheet 20 is formed of a metal dome. The dome sheet 20 may be formed of a conductive metal material (e.g., copper, nickel, aluminum, silver, tin, or the like).

Figure 5:
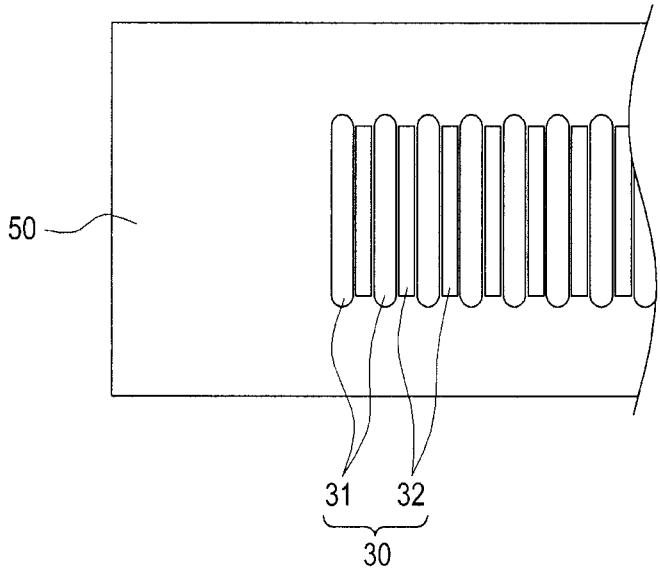
FIG. 5 is a plane view of a contact module of a dome switch device according to a first exemplary embodiment of the present invention.

As shown in FIG. 5, the both-pole contact portions 31 and 32 are comprised of positive-polarity ("+") contact portions 31 and negative-polarity ("−") contact portions 32.

As shown in FIGS. 4, 6, and 7, the both-pole contact portions 31 and 32 are arranged substantially perpendicular to the longitudinal direction of the dome sheet 20 to electrically contact the dome sheet 20. However, a person of ordinary skill in the art understands that other arrangements are within the spirit and scope of the claimed invention.

The dome switch device 10 shown in the drawings is intended for a keypad (not shown) of a portable communication device. However, other devices in addition to or instead of a portable communication device can benefit from the claimed invention.

The keypad is a keypad having a QWERTY arrangement. However, the keypad may also be a keypad having an arrangement other than the QWERTY arrangement, such as a keypad having a 3×4 key arrangement, DVORAK keypad, etc.

With reference to FIGS. 4 through 8, a description will now be made regarding an operating process of the foregoing dome switch device 10 according to a first exemplary embodiment of the present invention.

As shown in FIGS. 4 through 8, the dome switch device 10 preferably includes the dome sheet 20 having conductivity and the contact module 30. The dome sheet 20 extends in a longitudinal direction, and is preferably formed of a metal.

As shown in FIG. 5, the contact module 30 includes a plurality of both-pole contact portions 31 and 32 which comprise the "+" contact portions 31 and the "−" contact portions 32. The "+" contact portions 31 and the "−" contact portions 32 are arranged alternately on the substrate 50 in the longitudinal direction of the dome sheet 20.

In the state as shown in FIGS. 4, 6, and 7, the dome sheet 20 is provided (i.e. arranged at its edges on the substrate 50 so that the dome sheet 20 is arranged to be over the "+" contact portions 31 and the "−" contact portions 32. In this particular example, the dome sheet 20 is disposed to be substantially perpendicular to the "+" contact portions 31 and the "−" contact portions 32.

Figure 8:
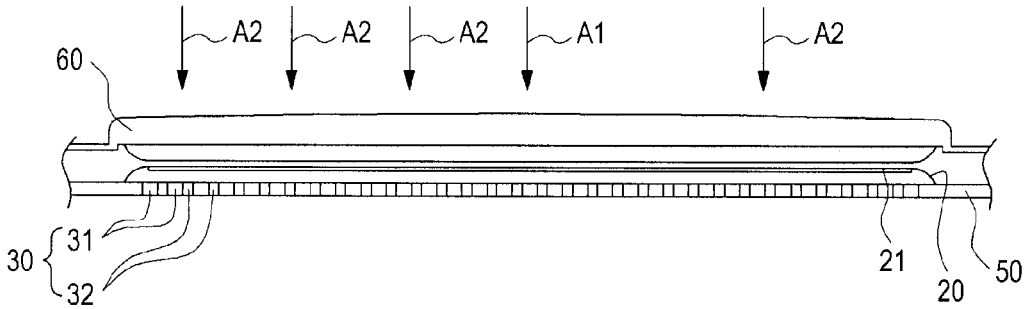
FIG. 8 is a side cross-sectional view showing a use state of a dome switch device according to a first exemplary embodiment of the present invention.

As shown in FIG. 8, arranged on a top surface of the dome sheet 20 is a key button 60 extending to face the dome sheet 20.

As shown in FIGS. 6, 7, and 8, when a user presses the key button 60, the dome sheet 20 is also pressed, thus electrically contacting the "+" contact portions 31 and the "−" contact portions 32.

When the dome sheet 20 electrically contacts the "+" contact portions 31 and the "−" contact portions 32, the substrate 50 recognizes the electric contact and generates a signal corresponding thereto.

As such, the dome sheet 20, when being pressed regardless of whether being pressed on a central region A1 thereof, or any other region (A2) other than the central region A1, can make electrical contact with the "+" contact portions 31 and the "−" contact portions 32.

As shown in FIGS. 6 through 8, at least one tension groove (s) 21 is formed in the dome sheet 20 along the longitudinal direction of the dome sheet 20, such that when the key button 60 presses the dome sheet 20, the dome sheet 20 is repulsively restored to the original state.

The repulsive restoring force of the dome sheet 20 is improved by the at least one tension grooves 21.

The dome switch device 10 can be arranged in a keypad (not shown) of a portable communication device, or many other types of electronic devices.

The keypad preferably includes a QWERTY arrangement.

Figure 2:
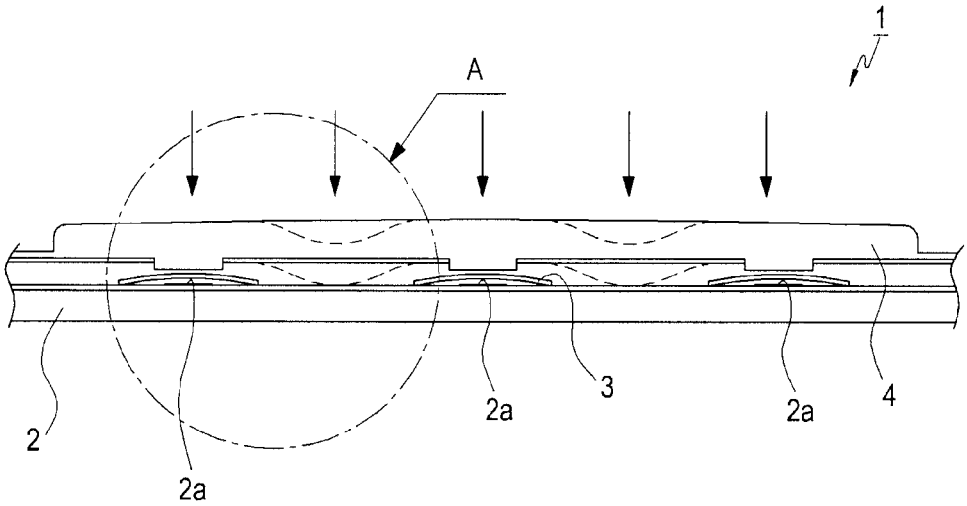
FIG.2 (PRIOR ART)
FIG. 2 is a side cross-sectional view showing an operating state of the conventional dome switch.
Figure 3:
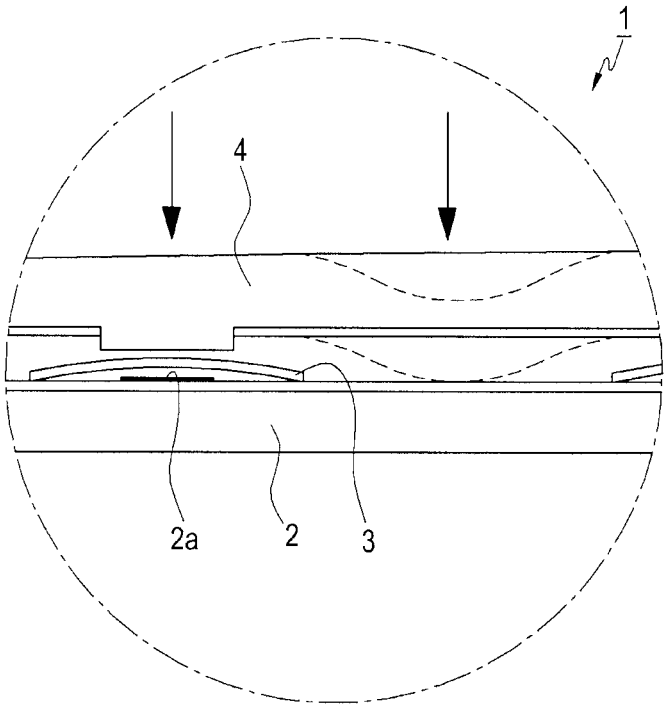
FIG.3 (PRIOR ART)
FIG. 3 is an enlarged side cross-sectional view of a portion A of FIG. 2.

As described herein above, the contact module 30 is configured to electrically contact the dome sheet 20 when the central region A1 of the dome sheet 20, or any other region A2, of the dome sheet 20 extending along the longitudinal direction is pressed, thereby improving the electric contact property of the product. The electric signal recognition of the product and a tactile sense (such as a clicking sense) of the product when pressing any area of the key button are both improved as compared with the conventional devices such as in FIGS. 1 to 3. Moreover, since an electric signal can be recognized equally when any other region A2 other than the central region A1 of the key button 60 provided on the keypad is pressed, the abrasion of the key button 60 can be prevented by a more dispersed actuation because pressing virtually anywhere along the key button will activate the function associated with the key button.

An operating process of a dome switch device 100 according to a second exemplary embodiment of the present invention will now be described in detail with reference to FIGS. 9 through 11.

Figure 9:
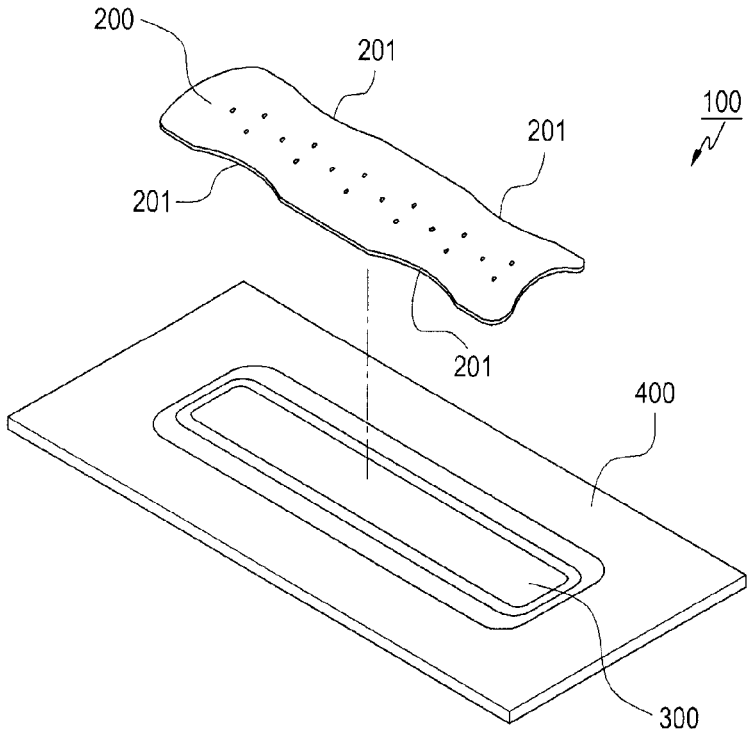
FIG. 9 is an exploded perspective view of a dome switch device according to a second exemplary embodiment of the present invention.
Figure 10:
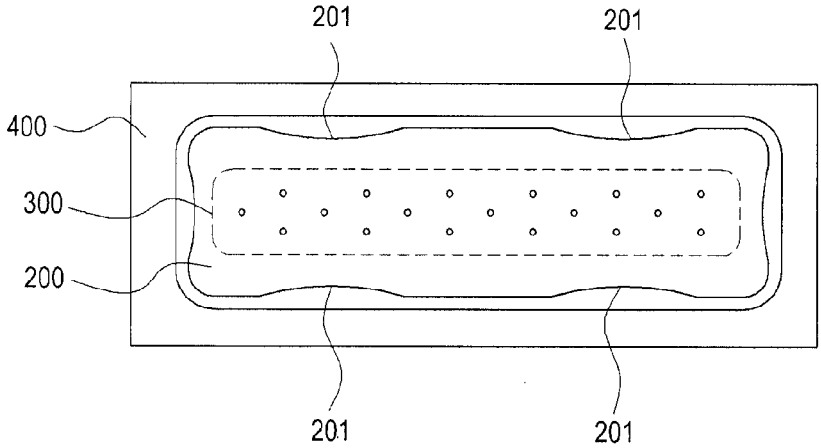
FIG. 10 is a plane view showing a coupled state of a dome switch device according to a second exemplary embodiment of the present invention.
Figure 11:
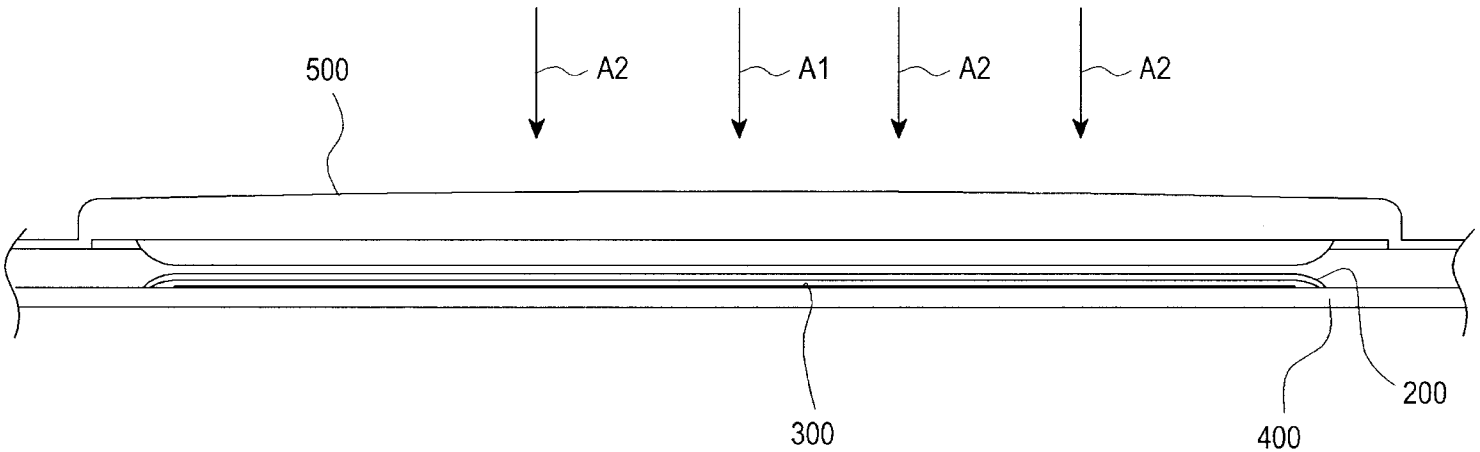
FIG. 11 is a side cross-sectional view showing a use state of a dome switch device according to a second exemplary embodiment of the present invention.

As shown in FIGS. 9 through 11, the dome switch device 100 preferably includes a dome sheet 200 having a conductive surface or portion thereof and a contact portion 300.

The dome sheet 200 preferably extends along a longitudinal direction, and can be comprised of a metal sheet shaped into a dome.

As shown in FIGS. 9 through 11, the contact portion 300 is provided on a substrate 400 to be formed along the longitudinal direction of the dome sheet 200.

As shown in FIGS. 10 and 11, the contact portion 300 is configured to electrically contact the dome sheet 200 when a central region A1 of the dome sheet 200, or when any other region A2 other than the central region A1 of the dome sheet 200 is pressed.

As shown in FIGS. 9 and 10, the at least one tension groove(s) 201 is formed in an outer circumference of the dome sheet 200 to improve the tension of the dome sheet 200.

The dome switch device 100 can be arranged in a keypad (not shown) of a portable communication device, or many other various types of electronic devices.

The keypad includes a QWERTY arrangement, and the keypad may also include any other arrangement other than the QWERTY arrangement, including but in no way limited to a 3×4 key arrangement.

According to this exemplary embodiment of the present invention, when the user presses an extending key button 500, the dome sheet 200 is also pressed, thus electrically contacting the contact portion 300.

When the user presses the central region A1 of the key button 500 or any other region A2 other than the central region A1 of the key button 500, the dome sheet 200 is also pressed, thus electrically contacting the contact portion 300.

The substrate 400 recognizes the electric contact between the dome sheet 200 and the contact portion 300 and generates a signal corresponding thereto.

In this way, the dome sheet 200, when being pressed regardless of the position along the button, (e.g. whether being pressed on a central region A1 thereof or any other region A2 other than the central region A1), makes electrical contact with the contact portion 300.

The at least one tension groove(s) 201 is formed preferably in the outer circumference of the dome sheet 200, such that when the key button 500 presses against the dome sheet 200, the dome sheet 200 is repulsively restored to the original state by the tension grooves 201.

As such, the repulsive restoring force of the dome sheet 200 is improved by the at least one tension grooves 201.

As described above, the contact portion 300 is configured to electrically contact the dome sheet 200 when the central region A1 of the dome sheet 200 or any other region A2 of the dome sheet 200 extending along the longitudinal direction is pressed, thereby improving the electric contact properties of an electronic product and thus the electric signal recognition of the product, as well as improving a tactile feel such as a clicking sense of the product. Moreover, since an electric signal can be recognized equally when any other region A2 other than the central region A1 of the key button 500 provided on the keypad is pressed, the abrasion of the key button 500 can be prevented.

Meanwhile, it has been described that the dome switch devices 10 and 100 according to the exemplary embodiments of the present invention are applied to a portable communication device as a representative application example. However, the portable communication device is not limited to a mobile communication terminal and may be various types of electronic devices to which the dome switch devices 10 and 100 are applicable, such as a computer keyboard, a notebook, a bar-type terminal, a folder-type terminal, a sliding-type terminal, a swing-type terminal, and so forth, just to name a few possibilities.

Exemplary embodiments of the present invention may include not only mobile communication terminals operating according to communication protocols corresponding to various communication systems, but also any information communication apparatuses and multimedia apparatuses such as Portable Multimedia Players (PMPs), MP3 players, navigation systems, game consoles, notebooks, advertising boards, TVs, digital broadcasting players, Personal Digital Assistants (PDAs), smart phones, and so forth, and their application apparatuses.

A person of ordinary skill in the art would appreciate that a docking station for a portable communication device according to the present invention described above is not limited by the foregoing exemplary embodiments and drawings, and that various substitutions, modifications, and changes can be made both in the structure of the dome sheet, key buttons (which may not be actual physical buttons could be virtual buttons, contact portions, and in terminals having various exterior shapes such as a sliding type, a swing type, a waterproof terminal, and so forth.

What is claimed is:

1. A dome switch device comprising:

a dome sheet extending along a lengthwise direction, the dome sheet including an electrically conductive portion;

a substrate extending along a longitudinal direction; and a contact module provided on the substrate, the contact module and having a central region and at least one other region other than the central region such that a plurality of both-pole contact portions are arranged alternately along a length of the substrate so as to along the longitudinal direction of the dome sheet to correspond with the conductive portion of the dome sheet, the electrically conductive portion extending continuously along the length of the substrate, wherein the contact module electrically contacts the dome sheet when the dome sheet is pressed, regardless of whether the dome sheet is pressed on the central region thereof or any other region other than the central region of the dome sheet along the lengthwise direction of the dome sheet.

2. The dome switch device of claim 1, wherein one or more tension grooves are formed in the dome sheet along the longitudinal direction of the dome sheet.

3. The dome switch device of claim 1, wherein the dome sheet is comprised of a metal.

4. The dome switch device of claim 1, wherein the both-pole contact portions comprise respective positive-polarity ("+") contact portions and negative-polarity ("−") contact portions.

5. The dome switch device of claim 1, wherein the both-pole contact portions are arranged on the substrate to be substantially perpendicular to the longitudinal direction of dome sheet.

6. The dome switch device of claim 1, wherein the dome switch device is arranged in a keypad of a portable communication device.

7. The dome switch of claim 6, wherein the keypad comprises a QWERTY keyboard.

8. The dome switch device of claim 6, wherein the keypad comprises a 3 ×4keyboard.

9. The dome switch device according to claim 6, wherein the keypad further comprises a key button arranged over the dome sheet so that pressing of the key button causes the dome sheet to be pressed and make electrical contact with the contact module by pressing against the contact module regardless of a location of the key button being pressed.

10. The dome switch device according to claim 1, wherein the dome sheet provides a tactile sense regardless of whether the central region or any portion other than the central region of the dome sheet is pressed.

11. A dome switch device comprising:

a dome sheet extending along a lengthwise direction, the dome sheet including an electrically conductive portion; and a contact portion formed below the dome sheet along the longitudinal direction of the dome sheet, the contact portion having a length, the electrically conductive portion extending continuously along the length of the contact portion, wherein the contact portion electrically contacts the dome sheet when the dome sheet is pressed regardless, of whether the dome sheet is pressed on a central region thereof or any other region other than the central region along the lengthwise direction of the dome sheet.

12. The dome switch device of claim 11, wherein at least one tension groove is formed in an outer perimeter of the dome sheet so as not to be in contact with the contact portion when the dome sheet is pressed.

13. The dome switch device of claim 11, wherein the dome sheet is comprised of metal.

14. The dome switch device of claim 11, wherein the dome switch device is arranged in a keypad of a portable communication device.

15. The dome switch device of claim 11, wherein the contact portion is arranged on a substrate.

16. The dome switch device of claim 11, wherein the dome sheet provides a tactile sense when pressed regardless of whether the central region or any portion other than the central region of the dome sheet is pressed.

17. The dome switch according to claim 16, wherein the tactile sense comprises a clicking sense.

18. The dome switch of claim 14, wherein the keypad comprises a QWERTY keyboard.

19. The dome switch device of claim 14, wherein the keypad comprises a 3 ×4keyboard.

20. The dome switch device of claim 14, wherein the keypad comprises a space bar.

* * * * *

UNITED STATES PATENT AND TRADEMARK OFFICE

CERTIFICATE OF CORRECTION

PATENT NO. : 8,723,066 B2
APPLICATION NO. : 13/360945
DATED : May 13, 2014
INVENTOR(S) : Kyong-Su Shin et al.

It is certified that error appears in the above-identified patent and that said Letters Patent is hereby corrected as shown below:

In the Claims

Column 7, Claim 1, Line 7 should read as follows:
--...is pressed regardless of...--

Column 7, Claim 8, Line 31 should read as follows:
--...comprises a 3 × 4 keyboard...--

Column 8, Claim 11, Line 11 should read as follows:
--...is pressed regardless of...--

Column 8, Claim 19, Line 35 should read as follows:
--...comprises a 3 × 4 keyboard...--

Signed and Sealed this
Eighth Day of July, 2014

Michelle K. Lee

Michelle K. Lee
*Deputy Director of the United States Patent and Trademark Office*